US006832658B2

(12) United States Patent
Keast

(10) Patent No.: US 6,832,658 B2
(45) Date of Patent: Dec. 21, 2004

(54) TOP DRIVE SYSTEM

(76) Inventor: Larry G. Keast, 9314 Livernois, Houston, TX (US) 77080

( * ) Notice: Subject to any disclaimer, the term of this patent is extended or adjusted under 35 U.S.C. 154(b) by 79 days.

(21) Appl. No.: 10/269,262

(22) Filed: Oct. 11, 2002

(65) Prior Publication Data

US 2004/0069532 A1 Apr. 15, 2004

(51) Int. Cl.[7] ..... E21B 3/02
(52) U.S. Cl. ..... 175/170; 175/85; 166/77.52
(58) Field of Search ..... 175/170, 85, 195, 175/162, 220; 166/77.51, 77.52

(56) References Cited

U.S. PATENT DOCUMENTS 2,998,084 A * 8/1961 Johnson et al. ..... 175/85
4,865,135 A 9/1989 Moses
5,251,709 A 10/1993 Richardson
5,272,925 A * 12/1993 Henneuse et al. ..... 73/862.541
5,365,674 A * 11/1994 Etchegoyhen et al. ..... 33/719
5,755,296 A 5/1998 Richardson et al.
6,032,744 A * 3/2000 Burge et al. ..... 166/385

* cited by examiner

*Primary Examiner*—William Neuder
(74) *Attorney, Agent, or Firm*—John R. Casperson

(57) ABSTRACT

A torque track in conjunction with parallelogram links and a hydraulic cylinder is used for multiple purposes in a drilling rig top drive system. The torque track is rotationally mounted within the mast between the crown and the rig floor and pivotally mounted by the parallel linkages to the sides of a power swivel. The hydraulic cylinder is mounted to an arm at the lower end of the track and it's other end is connected to the fixed rig structure. When the power swivel is supplying torque during drilling, the linkage transmits the torque to the track which is restrained from rotating by the hydraulic cylinder. The torque is thereby transmitted via the hydraulic cylinder to the fixed rig structure rather than the mast. The hydraulic cylinder can also be used as a load cell to allow torque measurement as well as to pivot the power swivel when needed for pipe handling purposes. The arrangement thus provides triple top drive functionality.

20 Claims, 5 Drawing Sheets

TOP DRIVE SYSTEM

BACKGROUND OF THE INVENTION

In one embodiment, this invention relates generally to a top drive system for a drilling rig.

Top drive is the oilfield definition of a power swivel in combination with certain additional features which facilitate torque reaction and pipe handling.

A power swivel is a hydraulic or electric powered rotating device which is suspended in or on the derrick, and which drives the drill pipe from above the rig floor, thus the name top drive. It replaces the rotary table, which drives the pipe from lower down, at the rig floor level.

The power swivel generates torque which is reacted by vertical track member(s) in the derrick in which the power swivel rides up and down. That is, this track is arranged such that the swivel torque is restrained no matter where the power swivel is vertically positioned in the derrick.

For lower torque levels, the vertical track members have historically been 1 or 2 wire ropes, tensioned between the top of the derrick and the rig floor. Torque reaction arm(s) mounted to the swivel are attached to the rope(s) by either common U-shaped fittings called shackles which slide up and down against the rope(s), or sheaves (pulleys) which provide rolling contact against the rope(s). This approach is low cost, fairly quick to rig up, and the loads imparted to the derrick by power swivels rated at lower torque levels are generally not significant. This is good for the rental tool business which rents the lower torque range of portable power swivels and cannot afford to be concerned with generating stresses in the customer's derrick.

For torque levels in the higher ranges, some form of rigid steel track members have been used, either attached to the derrick from top to bottom, or attached only at the top and bottom. In either of these cases, significant loads resulting from the swivel torque are transmitted to the derrick, and the derrick stress levels must be examined for safety.

The portable rental tool industry needs top drives which can be installed in any derrick without adding any torque loading whatsoever.

It is an object of this invention to provide a top drive system which can be installed in any derrick without adding any torque loading whatsoever.

It is a further object of this invention to provide a device which permits measurement of the torque being generated by the top drive.

It is another object of this invention to provide a top drive system which accomplishes multiple purposes, including torque reaction, torque measurement, and pipe handling, in a simple and low cost system.

SUMMARY OF THE INVENTION

In one embodiment, the invention provides an arrangement of a torque absorber unit, a track unit, a carriage unit, a power swivel, and linkage arms, for use on a drilling rig comprising a drilling rig floor structure and a mast structure positioned on the drilling rig floor structure.

For brevity, the arrangement is described in its installed configuration. The track unit comprises a track having an upper end and a lower end and a longitudinal axis. The track is mounted in the mast structure and to the drilling rig floor structure in a manner which permits limited rotational movement around the longitudinal axis of the track. The torque absorber unit is connected to the lower end of the track unit and to the drilling rig floor structure and limits rotation of the track. The carriage unit is mounted for vertical travel on the track and is capable of exerting torque to the track around the longitudinal axis of the track. The power swivel is for rotating the drill pipe and is suspended in the mast structure. At least one pair of linkage arms extends from opposite sides of the power swivel to opposite sides of the carriage unit. The linkage arms are mounted to both the power swivel and the carriage unit for pivoting movement in a horizontal plane. Torque generated by the power swivel can be transmitted from the power swivel to the drilling rig floor structure via the at least one pair of linkage arms, the carriage unit, the track unit and the torque absorber unit.

In another embodiment of the invention, there is provided a method for absorbing torque generated by power swivel in a drilling rig. The method is preferably carried out using the above described apparatus. The method is carried out by rotating a drill pipe with the power swivel, which results in the generation of reaction torque. The reaction torque is transmitted from the power swivel to the drilling rig floor structure via the at least one pair of linkage arms, the carriage unit, the track unit and the torque absorber unit.

In a preferred embodiment, the torque output from the power swivel is further measured. This is easily accomplished where the torque absorber unit is the form of a hydraulic cylinder coupled to a pressure gauge which has been calibrated to measure torque output from the power swivel.

In a further embodiment of the invention, there is provided a method for rotationally manipulating, with respect to a vertical axis, a power swivel in a drilling rig. The method is preferably carried out in the above described apparatus in an embodiment wherein the torque absorber unit comprises a hydraulic cylinder and piston mechanically connected at one end to the track and at the other end to the drilling rig floor structure. The apparatus further comprises a hydraulic actuator means in operable association with the torque absorber unit for selectively positioning the piston in a desired position. The hydraulic actuator means, preferably a pump and control valve, is employed to position the piston in a desired location, which in turn manipulates the rotational orientation of the power swivel via the track unit, the carriage unit, and the at least one pair of linkage arms. Thus, the same hydraulic cylinder that is used for torque reaction and torque measurement can be used for torque track manipulation as well. By providing pipe handling means facing outwardly from the power swivel, the same hydraulic cylinder can be further employed to perform top drive pipe handling functions.

The invention thus provides a drilling rig with top drive functions using a simple, low cost machine.

DETAILED DESCRIPTION OF THE INVENTION

Figure 1:
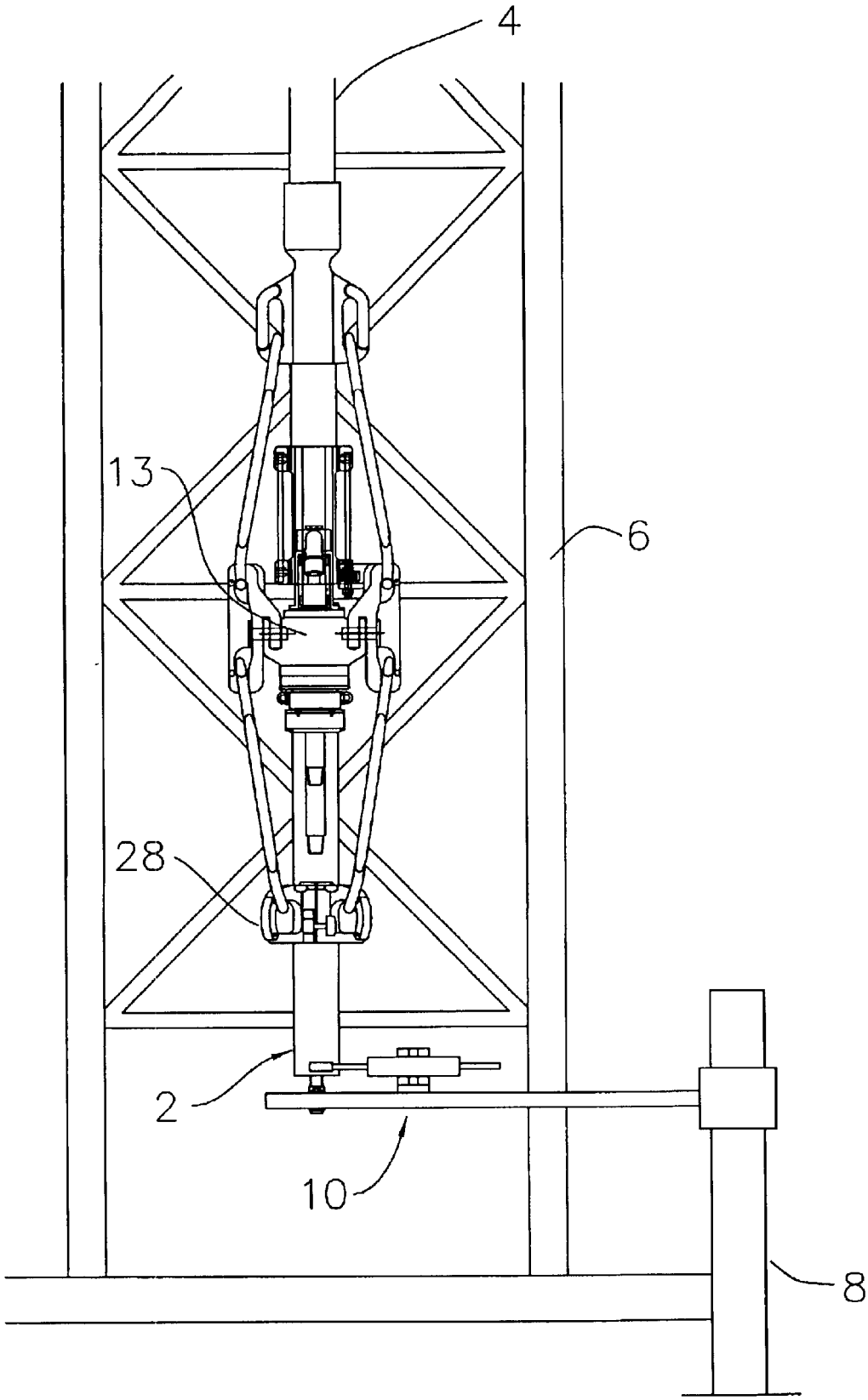
FIG. 1 is a frontal view schematically illustrating certain features of the top drive system of the invention as deployed in a drilling rig, the drill pipe, cables, control lines, and portions of the derrick structure not being shown for the sake of clarity.
Figure 2:
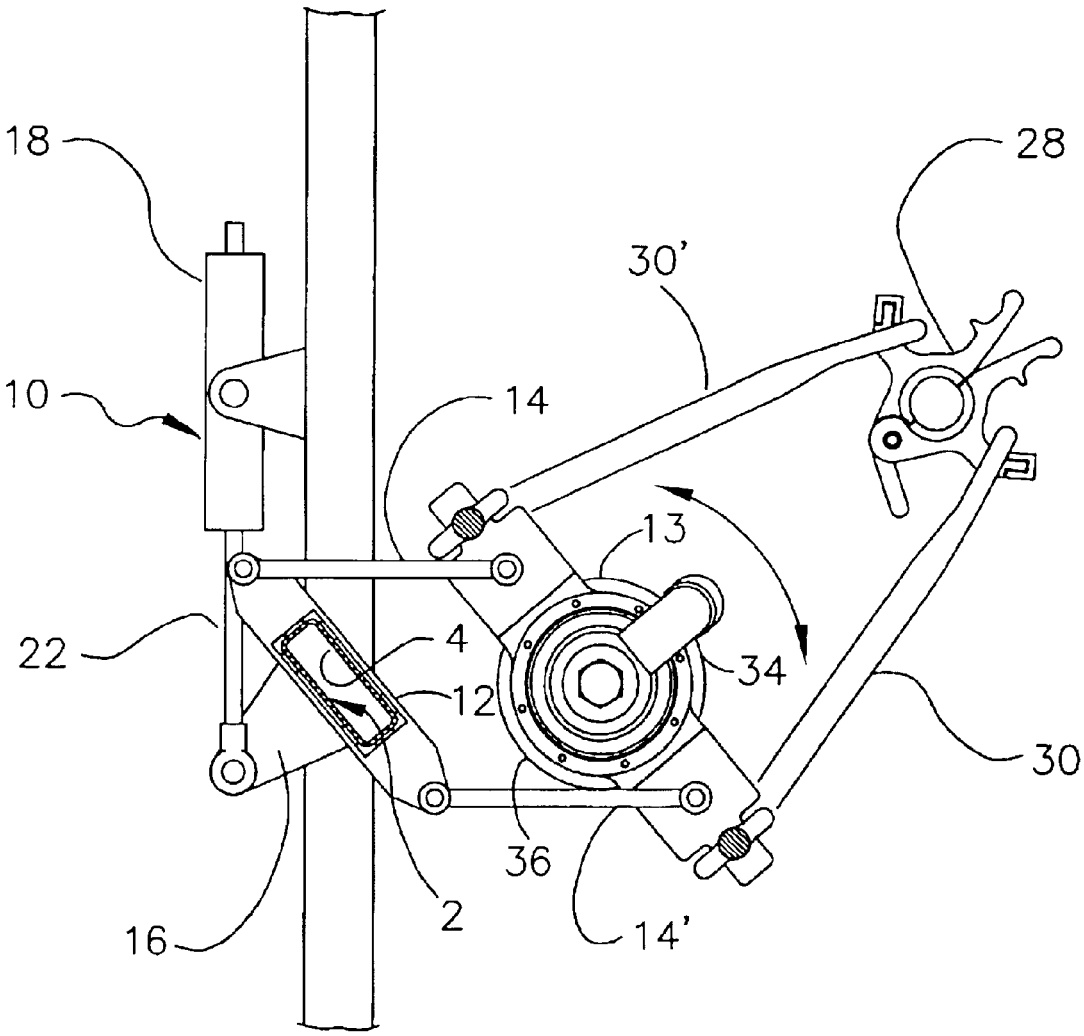
FIG. 2 is a top view of a portion of the device shown in FIG. 1 illustrating the pivot and linkage arrangement of elements used to absorb torque generated by the power swivel.

With reference to the Figures, the track unit 2 comprises a rigid track 4 having an upper end and a lower end and a longitudinal axis. The track is for mounting to, generally in, a mast structure 6 positioned on a drilling rig floor structure 8 in a manner to permit rotational movement of the track unit around the longitudinal axis of the track. The torque absorber unit 10 is for connecting the lower end of the track unit with the drilling rig floor structure. The carriage unit 12 is mountable for vertical travel on the track and is capable of transmitting torque to the track around the longitudinal axis of the track. The power swivel 13 is for rotating the drill pipe. At least one pair of linkage arms 14, 14' extend from opposite sides of the power swivel to opposite sides of the carriage unit. The linkage arms are mounted to both the power swivel and the carriage unit for rotational movement in a horizontal plane. Torque generated by the power swivel is transmitted from the power swivel to the drilling rig floor structure via the at least one pair of linkage arms, the carriage unit, the track unit and the torque absorber unit.

Preferably, the track unit extends vertically upwardly from the drilling rig floor structure, and is pivotally mounted to an upper portion of the mast structure and pivotally mounted to the drilling rig floor structure for limited rotational movement around the longitudinal axis of the track unit. Preferably, the track is mounted in bearing assemblies top and bottom and is located in the mast structure between the mast crown structure and the drilling rig floor. The track may further be longitudinally tensioned by a cable connecting the upper end of the track to the mast crown structure. By drilling rig floor structure is meant the deck or strong structures mounted to or supporting the deck, such as the base of the mast structure or the substructures supporting the deck. The term mast crown structure is intended to include the gear including the crown sheaves at the top or crown of the mast. By employing this mounting technique and employing freely pivoting linkage arms, it is impossible for the track to impart torque to the mast.

The track unit preferably further comprises a base plate 16 connected to the lower end of the track unit and extending laterally from the track unit. The torque absorber unit preferably comprises at least one hydraulic cylinder 18 horizontally mounted to the drilling rig floor structure. The cylinder contains a movable piston 20 and a horizontal piston shaft 22 connecting the piston to the base plate. The piston shaft is preferably pivotally connected to the base plate. More preferably, the at least one hydraulic cylinder is mounted to the drilling rig floor structure for pivotal movement in the horizontal plane, and the horizontal piston shaft is pivotally connected to an outer end of the base plate for pivotal movement in the horizontal plane.

Figure 3:
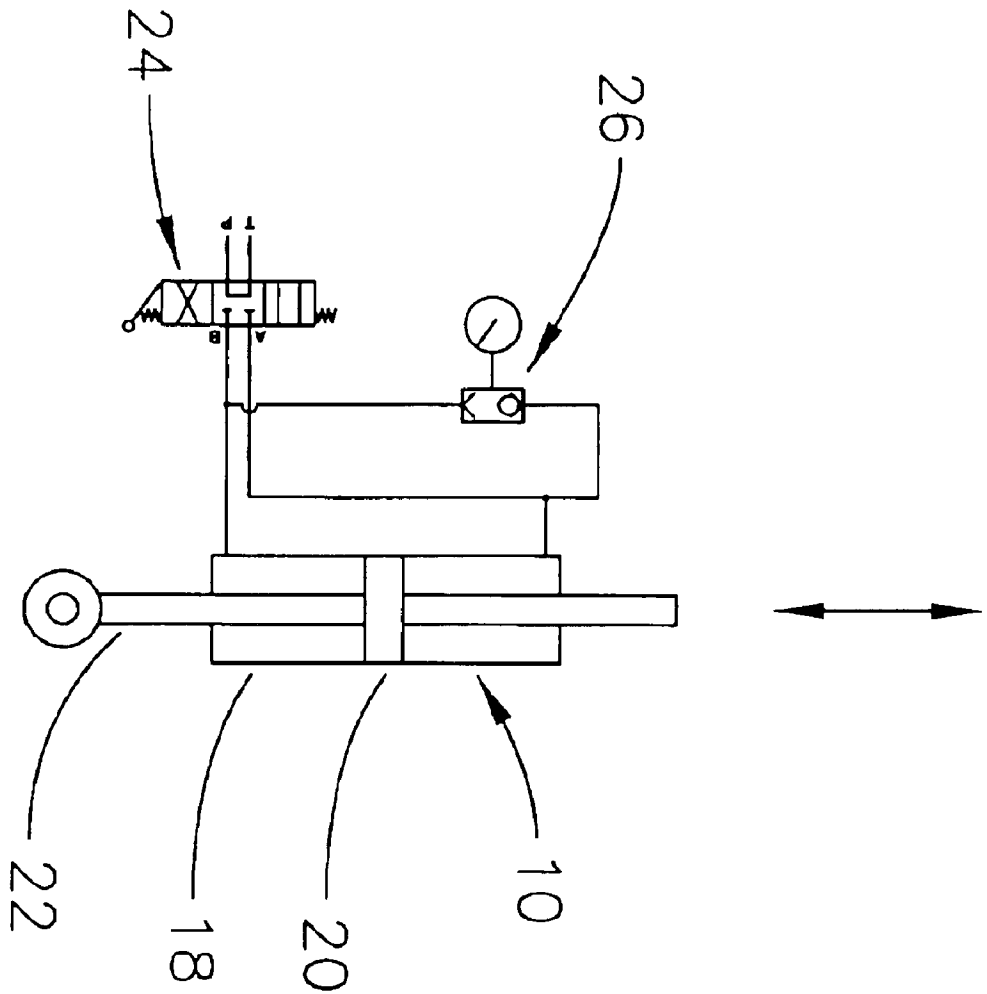
FIG. 3 is a schematic illustration of a hydraulic control system useful with the invention as illustrated in FIG. 2.

The piston divides the hydraulic cylinder into a first chamber and a second chamber. The apparatus preferably further comprises a fluid supply means 24 operatively connected to the hydraulic cylinder for driving the piston to a desired location in the hydraulic cylinder. See FIG. 3. The hydraulic cylinder applies rotational torque to the track unit which is transmitted to the power swivel via the track, the carriage unit, and the at least one pair of linkage arms, so that the power swivel is selectively rotatable from a first rotational position to a second rotational position in a variable manner. The same apparatus is thus useful for both torque reaction and pipe handling, i.e., it has dual functionality.

Additional functionality can be achieved by providing a pressure indication means 26 operatively connected with the fluid supply means to provide an indication of fluid pressure in the hydraulic cylinder. This enables the torque being generated by the power swivel to be easily determined. Over-torquing and possible pipe twist-off can thereby be prevented. Thus, triple functionality, and the system is easily automated.

The apparatus preferably further includes an elevator unit 28 for latching attachment to an upper end of a drill pipe string. A pair of elevator links 30, 30' extend from opposite sides of the power swivel to opposed sides of the elevator unit. A pair of actuator means 32, 32' connect the power swivel with an outer end portion of each elevator link for selectively moving the elevator unit from a lowered position to an extended position to lay down or pick up pipe.

Figure 4:
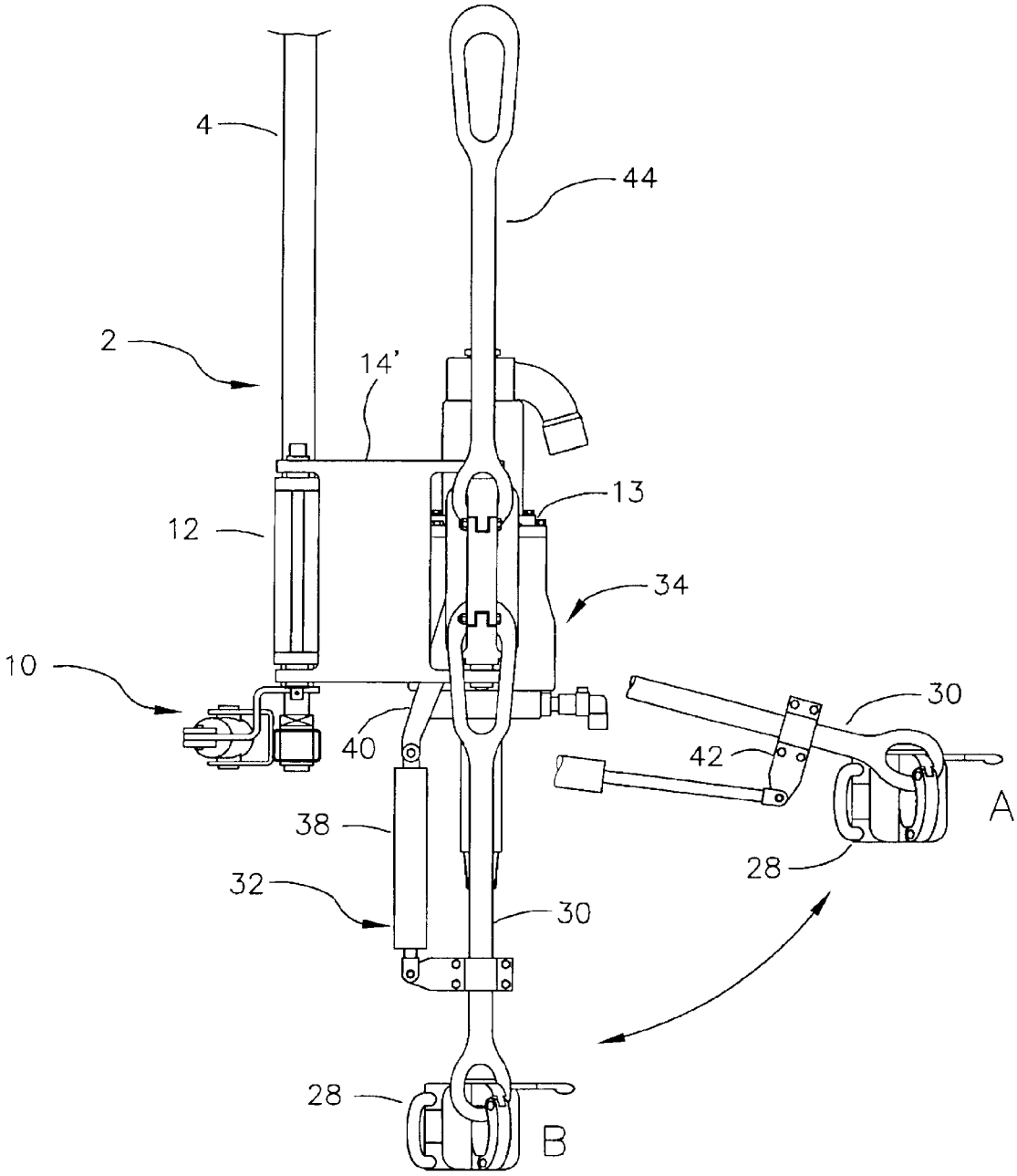
FIG. 4 is a side view of the device shown in FIG. 2, after having been rotated to a neutral position, the elevator arms having been moved from position A (illustrated in FIG. 2) to position B.
Figure 5:
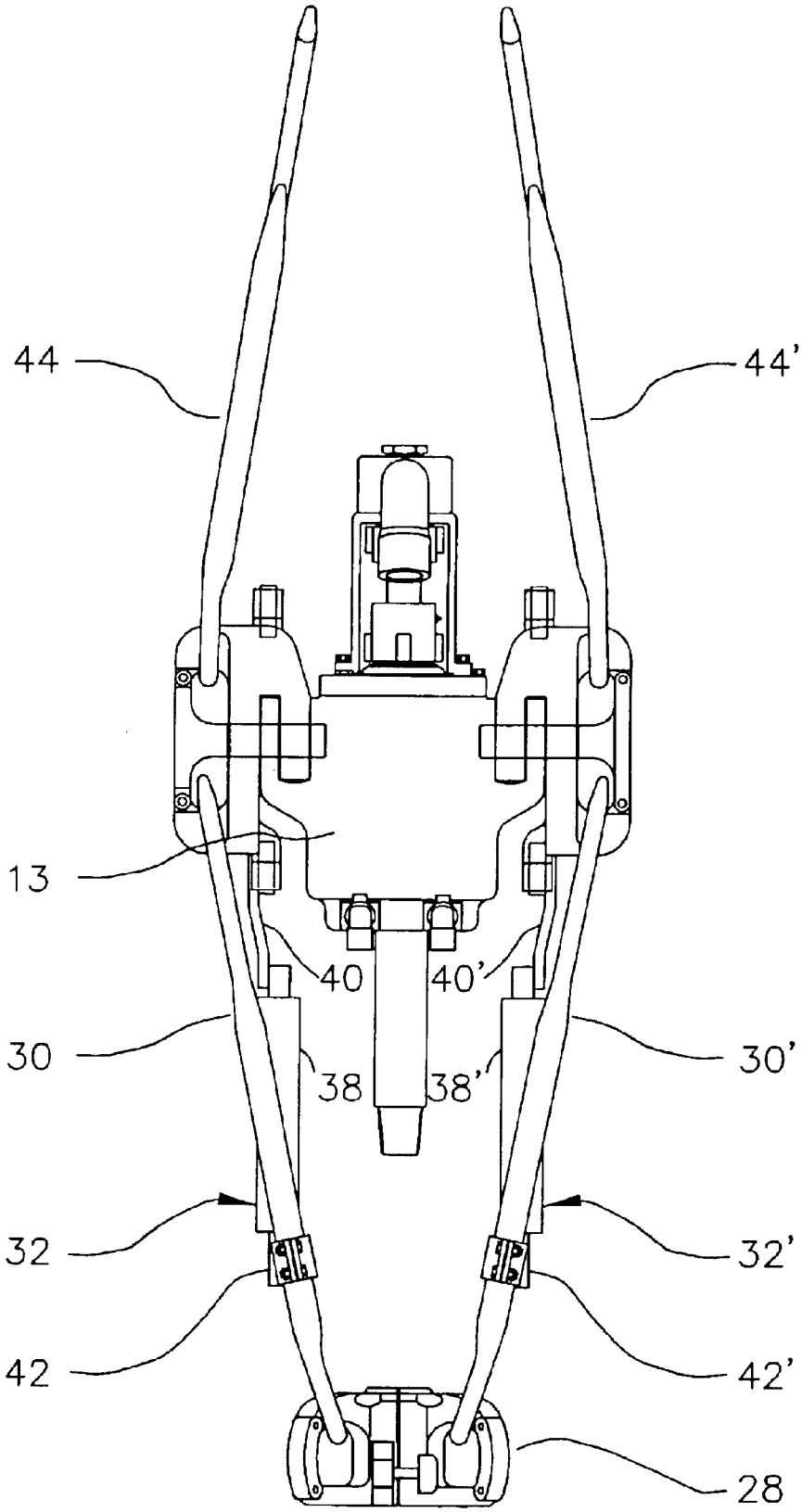
FIG. 5 is a frontal view of a portion of the device shown in FIG. 1, to illustrate certain features in greater detail.

The power swivel can be described as having a front side 34 and a back side 36. The linkage arms extend generally away from the back side of the power swivel and the elevator links are mounted for movement generally on the front side of the power swivel from the lowered position ("B" in FIG. 4) to the extended position ("A" in FIG. 4).

Each actuator means preferably comprises a hydraulic cylinder unit 38, 38' having a first end and a second end pivotally connected by its first end to a rigid support structure 40, 40' extending from the power swivel alongside its respective elevator link and pivotally connected by its second end to a bracket structure 42, 42' extending transversely from the elevator link.

The power swivel is preferably suspended via hanger links 44, 44' from a traveling block which is in turn suspended from the mast crown structure and selectively movable up and down.

Preferably, the track has a generally rectangular cross section, having a length and a width, is of hollow construction, and is provided with generally cylindrical, axially-extending shafts at its ends for rotational mounting. The carriage unit has a passage therethrough of generally rectangular cross section to match the track, and a width which is preferably on the order of the length of the linkage arms. The carriage unit has an upper end and a lower end and a length as measured between the upper end and the lower end and the linkage arms are attached at both the upper end and the lower end of the carriage unit. In the illustrated embodiment, the linkage arms are formed from plates and the length of the carriage unit is about the same as the width of the track, to provide pitch stability.

In another embodiment of the invention, there is provided a method for absorbing torque generated by a power swivel in a drilling rig. The drilling rig comprises a mast structure mounted to a drilling rig floor structure. A track unit comprising a rigid track having an upper end and a lower end and a longitudinal axis is mounted in the mast structure and the drilling rig floor structure to permit rotational movement of the track unit around the longitudinal axis of the track. A torque absorber unit is provided connecting the lower end of the track unit with the drilling rig floor structure and permitting limited rotational movement of the track unit. A carriage unit is mounted for vertical movement on the track. The carriage unit is capable of transmitting torque to the track around the longitudinal axis of the track. A power swivel is provided for rotating a drill pipe. The power swivel is suspended in the mast structure. At least one pair of linkage arms extending from opposite sides of the power swivel to opposite sides of the carriage unit is provided. The at least one pair of linkage arms is mounted to both the power swivel and the carriage unit for pivoting movement in a horizontal plane. A drill pipe is then rotated with the power swivel which results in the generation of reaction torque. The reaction torque is transmitted from the power swivel to the drilling rig floor structure via the at least one pair of linkage arms, the carriage unit, the track unit and the torque absorber unit.

In a preferred embodiment, the torque absorber unit comprises a hydraulic cylinder and piston mechanically connected at one end to the track and at the other end to the drilling rig floor structure. Torque is hydraulically transmitted from the track to the drilling rig floor structure via the torque absorber unit.

In a further preferred embodiment, a pressure sensor is operatively associated with the torque absorber unit. An electrical signal is produced with the pressure sensor which is representative of a fluid pressure in the torque absorber unit. This pressure can be correlated with the torque being applied by the power swivel, and the signal can be further used to trigger an alarm or reduce (or increase) the power applied by the power swivel.

In a further embodiment of the invention, there is provided a method for rotationally manipulating, with respect to a vertical axis, a power swivel in a drilling rig. The drilling rig comprises a mast structure mounted to a drilling rig floor structure. The method comprises providing a track unit comprising a rigid track having an upper end and a lower end and a longitudinal axis mounted in the mast structure and to the drilling rig floor structure to permit rotational movement of the track unit around the longitudinal axis of the track. A torque absorber unit is provided connecting the lower end of the track unit with the drilling rig floor structure and permitting limited rotational movement of the track unit. The torque absorber unit comprises a hydraulic cylinder and piston mechanically connected at one end to the track and at the other end to the drilling rig floor structure. A carriage unit is mounted for vertical movement on the track. The carriage unit is capable of transmitting rotational torque to the track around the longitudinal axis of the track. A power swivel is provided for rotating a drill pipe. The power swivel is suspended in the mast structure. At least one pair of linkage arms is provided extending from opposite sides of the power swivel to opposite sides of the carriage unit. The linkage arms are mounted to both the power swivel and the carriage unit for rotational movement in a horizontal plane. A hydraulic actuator means is provided in association with the torque absorber unit for selectively positioning the piston in a desired position. The hydraulic actuator means is employed to position the piston in a desired location and manipulate the rotational orientation of the power swivel via the track unit, the carriage unit, and the at least one pair of linkage arms.

In a further preferred embodiment, an elevator unit is provided for latching attachment to an upper end of a drill pipe string. A pair of elevator links is provided extending from opposite sides of the power swivel to opposed sides of the elevator unit. A pair of actuator means for the elevator links is provided, each actuator means being mechanically connected at one end to the power swivel and at the other end to an elevator link for selectively moving the elevator unit from a lowered position to an extended position. The pair of actuator means is employed to selectively move the elevator unit between the lowered position and the extended position. By manipulating the position of the traveling block, the rotational orientation of the power swivel, and the extension and retraction of the elevator arms, drill pipe can be moved at will from the drill string to storage and back.

Further Description of Preferred Embodiments

The following three sections further explain the novel method in which the torque track and links are used to effect multiple purposes previously requiring much more involved and more costly equipment.

Torque Reaction Purpose of Torque Track and Links

Typical top drives on the market transmit power swivel torque to the tracks, imparting torque and at least some side loads to the derrick. My invention imparts only torque to the track assembly, and no side loads to the derrick. Torque in the track is reacted only by a base plate assembly at the floor level. To initially raise the track to vertical during installation, a hoist cable is attached to a lifting point on top of the track. The track is free to rotate in bearings, top and bottom, being restrained from rotating only by the torque absorber unit mounted to the drilling rig structure at the bottom end.

The torque reaction mechanism includes two link plates which are arranged with bearings in a parallelogram linkage. These link plates connect each side of the power swivel to each side of a carriage which is free to travel up and down the track with the power swivel. As the power swivel generates torque and tries to rotate, one link is in tension, the other in compression. Through this mechanism, only torque can be applied to the track, which is restrained from rotating only at the floor. No side loads are imparted to the center bearing at the top of the track, even when the power swivel is supplying drilling torque near the top of the track. All other known power swivel top drives, because their torque transmitting links are rigid, not frictionless bearing-mounted, inherently transmit a side load to the track along with torque.

Torque Measurement Purpose of Torque Track and Links

The invention also provides a unique mechanism for accurate torque measurement. As has been discussed, the torque imparted to the track is reacted by a base plate assembly which is arranged as follows. The vertical torque track is actually supported between top and bottom bearings. It is seen, then, that during rigup, before the power swivel and links are attached, and before the torque absorbing hydraulic cylinder is attached, the vertical track is free to spin on its axis between its top and bottom bearings. In operation, the track is restrained from rotating by a hydraulic cylinder(s), a common torque measuring device, but one which has never been used in this manner to measure torque of a power swivel. Historically, power swivel torque has been measured by a hydraulic pressure gauge which is calibrated in foot-pounds of torque. This method always lacks accuracy as there are considerable losses which are quite variable, and therefore which cannot be accurately taken into account. These losses occur between the power swivel hydraulic motor input and the actual torque output to the drill pipe, and include gear train losses, seal and bearing frictions which vary with speed and temperature, and packing grip on the washpipe which varies with mud pump pressure and packing lubrication. Another major inaccuracy is due to the considerable pressure drop due to high flow rates in the hoses at high speed. This embodiment of the invention accurately measures the true output torque of the power swivel, because only the torque available to rotate the pipe is reacted by the torque track. For the first time, actual power swivel torque output will be accurately measured.

Pipe Handling Purpose of Torque Tracks and Links

The invention further provides a pipe handling function, normally required in a top drive, using the torque track, parallelogram links, and the torque measuring hydraulic cylinder(s).

When pipe is not attached to the power swivel, such as between connections when drilling, an oilfield elevator attached to the swivel must be remotely manipulated to pick up the next joint of pipe from a variety of positions including the mousehole or the v-door at the bottom of power swivel travel, and the racking position at the top. As is seen, additional hydraulic cylinders are used to extend the reach of the elevators, and rotation (lateral elevator swing) is provided by the same hydraulic cylinder(s) used otherwise for measuring torque. During this pipe handling function, the power swivel is not drilling or providing torque, so the hydraulic cylinder is not measuring torque. Instead, the cylinder is now being powered by a hydraulic power source through a conventional directional control valve to provide power rotational movement of the bearing-mounted torque track as required to manipulate the elevator. The simple hydraulic circuit is arranged to allow independent dual purposes of either the torque measurement pipe handling.

While certain preferred embodiments of the invention have been described herein, the invention is not to be construed as being so limited, except to the extent that such limitations are found in the claims.

What is claimed is:

1. Apparatus comprising a drilling rig floor structure;

a mast structure positioned on the drilling rig floor structure and having a mast crown structure at its upper end;

a track unit comprising a rigid track having an upper end and a lower end and a longitudinal axis mounted within the mast structure and to the drilling rig floor structure in a manner which permits rotational movement of the track unit around the longitudinal axis of the track;

a torque absorber unit connecting the lower end of the track unit to the drilling rig floor structure and limiting rotational movement of the track unit;

a carriage unit mounted for vertical travel on the track and capable of transmitting torque to the track around the longitudinal axis of the track;

a power swivel suspended from the mast crown structure for rotating a drill pipe; and at least one pair of linkage arms extending from opposite sides of the power swivel to opposite sides of the carriage unit, said at least one pair of linkage arms being mounted to both the power swivel and the carriage unit for rotational movement in a horizontal plane;

so that reaction torque generated by the power swivel is transmitted from the power swivel to the drilling rig floor structure via the at least one pair of linkage arms, the carriage unit, the track unit and the torque absorber unit.

2. Apparatus as in claim 1 wherein the track unit extends vertically upwardly from the drilling rig floor structure and is mounted to an upper portion of the mast structure and to the drilling rig floor structure for free rotational movement around the longitudinal axis of the track unit, being restrained from rotating only by the torque absorber unit.

3. Apparatus comprising a drilling rig floor structure;

a mast structure positioned on the drilling rig floor structure and having a mast crown structure at its upper end;

a track unit comprising a rigid track having an upper end and a lower end and a longitudinal axis mounted within the mast structure and to the drilling rig floor structure in a manner which permits limited rotational movement of the track unit around the longitudinal axis of the track;

a torque absorber unit connecting the lower end of the track unit to the drilling rig floor structure and limiting rotational movement of the track unit;

a carriage unit mounted for vertical travel on the track and capable of transmitting torque to the track around the longitudinal axis of the track;

a power swivel suspended from the mast crown structure for rotating a drill pipe; and at least one pair of linkage arms extending from opposite sides of the power swivel to opposite sides of the carriage unit, said at least one pair of linkage arms being mounted to both the power swivel and the carriage unit for rotational movement in a horizontal plane;

so that reaction torque generated by the power swivel is transmitted from the power swivel to the drilling rig floor structure via the at least one pair of linkage arms, the carriage unit, the track unit and the torque absorber unit, wherein the track unit extends vertically upwardly from the drilling rig floor structure and is mounted to an upper portion of the mast structure and to the drilling rig floor structure for limited rotational movement around the longitudinal axis of the track unit, and wherein the track unit further comprises a base plate connected to the lower end of the track unit and extending laterally therefrom, wherein the torque absorber unit comprises at least one hydraulic cylinder horizontally mounted to the drilling rig floor structure and containing a movable piston and a horizontal piston shaft connecting the piston to the base plate, said piston shaft being pivotally connected to the base plate.

4. An apparatus as in claim 3 wherein the at least one hydraulic cylinder is mounted to the drilling rig floor structure for rotational movement in the horizontal plane, and the horizontal piston shaft is pivotally connected to an outer end of the base plate for pivotal movement in the horizontal plane.

5. An apparatus as in claim 4 wherein the piston divides the hydraulic cylinder into a first chamber and a second chamber, said apparatus further comprising a fluid supply means operatively connected to the hydraulic cylinder for driving the piston to a desired location in the hydraulic cylinder, whereby the hydraulic cylinder applies torque to the track unit which is transmitted to the power swivel via the track, the carriage unit, and the at least one pair of linkage arms, so that the power swivel is selectively rotatable from a first rotational position to a second rotational position in a variable manner.

6. An apparatus as in claim 5 further comprising a pressure indication means operatively connected with the fluid supply means to provide an indication of fluid pressure in the hydraulic cylinder.

7. Apparatus as in claim 3 wherein the linkage arms are parallel to each other and are of equal length.

8. Apparatus comprising a drilling rig floor structure;

a mast structure positioned on the drilling rig floor structure and having a mast crown structure at its upper end;

a track unit comprising a rigid track having an upper end and a lower end and a longitudinal axis mounted within the mast structure and to the drilling rig floor structure in a manner which permits limited rotational movement of the track unit around the longitudinal axis of the track;

a torque absorber unit connecting the lower end of the track unit to the drilling rig floor structure and limiting rotational movement of the track unit;

a carriage unit mounted for vertical travel on the track and capable of transmitting torque to the track around the longitudinal axis of the track;

a power swivel suspended from the mast crown structure for rotating a drill pipe; and at least one pair of linkage arms extending from opposite sides of the power swivel to opposite sides of the carriage unit, said at least one pair of linkage arms being mounted to both the power swivel and the carriage unit for rotational movement in a horizontal plane;

so that reaction torque generated by the power swivel is transmitted from the power swivel to the drilling rig floor structure via the at least one pair of linkage arms, the carriage unit, the track unit and the torque absorber unit, wherein the track unit extends vertically upwardly from the drilling rig floor structure and is mounted to an upper portion of the mast structure and to the drilling rig floor structure for limited rotational movement around the longitudinal axis of the track unit.

said apparatus further comprising an elevator unit for latching attachment to an upper end of a drill pipe string;

a pair of elevator links extending from opposite sides of the power swivel to opposed sides of the elevator unit, and a pair of actuator means connecting the power swivel with an outer end portion of each elevator link for selectively moving the elevator unit from a lowered position to an extended position.

9. Apparatus as in claim 8 wherein the power swivel has a front side and a back side, wherein the linkage arms extend generally away from the back side of the power swivel; and wherein the elevator links are mounted for movement generally on the front side of the power swivel from the lowered position to the extended position.

10. Apparatus as in claim 9 wherein each actuator means each comprises a hydraulic cylinder unit having a first end and a second end pivotally connected by its first end to a rigid support structure extending from the power swivel alongside its respective elevator link and pivotally connected by its second end to a bracket structure extending transversely from the elevator link.

11. Apparatus as in claim 10 further comprising a traveling block suspended from the mast crown structure and selectively movable up and down, and a pair of hanger links extending from opposite sides of the traveling block to opposite sides of the power swivel to suspend the power swivel beneath the traveling block.

12. Apparatus as in claim 11 wherein the track has a generally rectangular cross section, having a length and a width, is of hollow construction, and is provided with generally cylindrical, axially-extending shafts at its ends for rotational mounting, and the carriage unit has a passage therethrough of generally rectangular cross section to match the track, and a width which is approximately equal to the length of the linkage arms.

13. Apparatus as in claim 12 wherein the carriage unit has an upper end and a lower end and a length as measured between the upper end and the lower end and the linkage arms are attached at both the upper end and the lower end of the carriage unit.

14. Apparatus as in claim 13 wherein the linkage arms are formed from plates and the length of the carriage unit is about the same as the width of the track.

15. A method for absorbing torque generated by a power swivel in a drilling rig comprising a mast structure mounted to a drilling rig floor structure, said method comprising:

providing a track unit comprising a rigid track having an upper end and a lower end and a longitudinal axis supported within the mast structure and the drilling rig floor structure to permit rotational movement of the track unit around the longitudinal axis of the track;

providing a torque absorber unit connecting the lower end of the track unit with the drilling rig floor structure and permitting limited rotational movement of the track unit;

providing a carriage unit mounted for vertical movement on the track and capable of transmitting torque to the track around the longitudinal axis of the track;

providing a power swivel for rotating a drill pipe, said power swivel unit being suspended in the mast structure;

providing at least one pair of linkage arms extending from opposite sides of the power swivel unit to opposite sides of the carriage unit, said at least one pair of linkage arms being mounted to both the power swivel and the carriage unit for rotational movement in a horizontal plane, rotating a drill pipe with the power swivel and generating reaction torque;

transmitting the reaction torque generated by the power swivel from the power swivel to the drilling rig floor structure via the at least one pair of linkage arms, the carriage unit, the track unit and the torque absorber unit.

16. A method for absorbing torque generated by a power swivel in a drilling rig comprising a mast structure mounted to a drilling rig floor structure, said method comprising:

providing a track unit comprising a rigid track having an upper end and a lower end and a longitudinal axis supported within the mast structure and the drilling rig floor structure to permit rotational movement of the track unit around the longitudinal axis of the track;

providing a torque absorber unit connecting the lower end of the track unit with the drilling rig floor structure and permitting limited rotational movement of the track unit;

wherein the torque absorber unit comprises a hydraulic cylinder and piston mechanically connected at one end to the track and at the other end to the drilling rig floor structure;

providing a carriage unit mounted for vertical movement on the track and capable of transmitting torque to the track around the longitudinal axis of the track;

providing a power swivel for rotating a drill pipe, said power swivel unit being suspended in the mast structure;

providing at least one pair of linkage arms extending from opposite sides of the power swivel unit to opposite sides of the carriage unit, said at least one pair of linkage arms being mounted to both the power swivel and the carriage unit for rotational movement in a horizontal plane, rotating a drill pipe with the power swivel and generating reaction torque; and transmitting the reaction torque generated by the power swivel from the power swivel to the drilling rig floor structure via the at least one pair of linkage arms, the carriage unit, the track unit and the torque absorber unit, wherein the reaction torque is hydraulically transmitted from the track to the drilling rig floor structure via the torque absorber unit.

17. A method as in claim 16 further comprising operatively associating a pressure sensor with the torque absorber unit, and producing an electrical signal with said pressure sensor representative of a fluid pressure in the torque absorber unit.

18. A method for rotationally manipulating, with respect to a vertical axis, a power swivel in a drilling rig, said drilling rig comprising a mast structure mounted to a drilling rig floor structure, said method comprising:

providing a track unit comprising a rigid track having an upper end and a lower end and a longitudinal axis mounted to the mast structure and the drilling rig floor structure to permit rotational movement of the track unit around the longitudinal axis of the track;

providing a torque absorber unit connecting the lower end of the track unit with the drilling rig floor structure and permitting limited rotational movement of the track unit, wherein the torque absorber unit comprises a hydraulic cylinder and piston mechanically connected at one end to the track and at the other end to the drilling rig floor structure;

providing a carriage unit mounted for vertical movement on the track and capable of transmitting torque to the track around the longitudinal axis of the track;

providing a power swivel for rotating a drill pipe, said power swivel being suspended in the mast structure;

providing at least one pair of linkage arms extending from opposite sides of the power swivel to opposite sides of the carriage unit, said at least one pair of linkage arms being mounted to both the power swivel and the carriage unit for rotating movement in a horizontal plane, providing a hydraulic actuator means for selectively positioning the piston in a desired position, and employing the hydraulic actuator means to position the piston in a desired location and manipulate a rotational orientation of the power swivel via the track unit, the carriage unit, and the at least one pair of linkage arms.

19. A method as in claim 18 further comprising providing an elevator unit for latching attachment to an upper end of a drill pipe string;

providing a pair of elevator links extending from opposite sides of the power swivel to opposed sides of the elevator unit;

providing a pair of actuator means for the elevator links each mechanically connected at one end to the power swivel and at the other end to an elevator link for selectively moving the elevator unit from a lowered position to an extended position; and employing the pair of actuator means to selectively move the elevator unit between the lowered position and the extended position.

20. Apparatus comprising a track unit comprising a rigid track having an upper end and a lower end and a longitudinal axis adapted for mounting within a mast structure and to a drilling rig floor structure which supports the mast structure in a manner which permits rotational movement of the track unit around the longitudinal axis of the track;

a torque absorber unit for connecting the lower end of the track unit to a drilling rig floor structure and limiting rotational movement of the track unit, wherein the torque absorber unit comprises at least one hydraulic cylinder containing a movable piston;

a carriage unit mountable for vertical travel on the track and capable of transmitting torque to the track around the longitudinal axis of the track; and at least one pair of linkage arms for extending from opposite sides of a power swivel to opposite sides of the carriage unit, said at least one pair of linkage arms being mountable to both the power swivel and the carriage unit for rotational movement in a horizontal plane;

so that reaction torque generated by a power swivel can be transmitted to a drilling rig floor structure via the at least one pair of linkage arms, the carriage unit, the track unit and the torque absorber unit without imparting stresses to a mast structure supported on the drilling rig floor structure.

* * * * *